US007078005B2

(12) United States Patent
Smith et al.

(10) Patent No.: US 7,078,005 B2
(45) Date of Patent: Jul. 18, 2006

(54) PROCESS FOR THE REDUCTION OR ELIMINATION OF HYDROGEN SULPHIDE

(75) Inventors: Hubern Larry Smith, Center, TX (US); Anne Faistrup Johnsen, Trondheim (NO); Børre Leif Knudsen, Trodheim (NO)

(73) Assignee: M-I L.L.C., Houston, TX (US)

( * ) Notice: Subject to any disclaimer, the term of this patent is extended or adjusted under 35 U.S.C. 154(b) by 61 days.

(21) Appl. No.: 10/250,436

(22) PCT Filed: Dec. 21, 2001

(86) PCT No.: PCT/GB01/05758

§ 371 (c)(1),
(2), (4) Date: Dec. 15, 2003

(87) PCT Pub. No.: WO02/051968

PCT Pub. Date: Jul. 4, 2002

(65) Prior Publication Data

US 2004/0096382 A1 May 20, 2004

(30) Foreign Application Priority Data

Dec. 27, 2000 (GB) ..... 0031710.7

(51) Int. Cl.
*C01B 17/16* (2006.01)

(52) U.S. Cl. ..... 423/226; 423/228

(58) Field of Classification Search ..... 502/401, 502/402; 423/221, 242.1, 242.3, 242.4, 226, 423/228

See application file for complete search history.

(56) References Cited

U.S. PATENT DOCUMENTS 4,894,210 A * 1/1990 Denny et al. ..... 423/230
5,569,443 A * 10/1996 Wilson et al. ..... 423/576.6
6,251,348 B1 * 6/2001 Scranton, Jr. ..... 423/244.01
6,887,445 B1 * 5/2005 Braga et al. ..... 423/244.06

* cited by examiner

*Primary Examiner*—Edward M. Johnson
(74) *Attorney, Agent, or Firm*—Carter J. White

(57) ABSTRACT

The invention provides a process for reducing the level of hydrogen sulphide in a liquid or gas by treatment of the liquid or gas with an $H_2S$-scavenger product derivable by the reaction of a carbonyl group-containing compound with an alcohol, thiol, amide, thioamide, urea or thiourea. The carbonyl group-containing compound is preferably formaldehyde, and preferably the product is derivable by reaction of formaldehyde with an amine-free alcohol or urea selected from ethylene glycol, propylene glycol, glycerol, diethylene glycol, triethylene glycol, ethyl alcohol, n-butanol, a sugar, a low molecular weight polyvinyl alcohol, castor oil fatty acid and urea. More especially, the scavenger product is used with an amine, especially monoethanolamine.

30 Claims, 7 Drawing Sheets

PROCESS FOR THE REDUCTION OR ELIMINATION OF HYDROGEN SULPHIDE

This application claims priority under 35 USC §371 of International application number PCT/GB01/05758, filed 21 Dec. 2001 which claims priority to United Kingdom (GB) application number 0031710.7, filed 27 Dec. 2000.

This invention relates to the reduction or elimination of hydrogen sulphide from gases and liquids, including gaseous and liquid hydrocarbons, and sewage gases, more especially from natural gas and liquid hydrocarbon streams.

Various methods have been used for the removal of hydrogen sulphide and other potentially undesirable sulphur-containing organic species such as mercaptans from liquid and gaseous hydrocarbons.

In one process a stream of the hydrocarbon is first contacted with an alkaline liquid such as an amine or a solution of a metallic hydroxide, causing the formation of water-soluble sulphide salts. These salts can be preferentially extracted into the water layer, and later converted to elemental sulphur by an oxidation process. These processes are effective, but are expensive to implement and require considerable investment in equipment, space and maintenance.

In another process sulphide ions are removed from crude oil stocks in refinery operations by the use of a dialkylamine reacted with an aldehyde such as formaldehyde in the approximate ratio of 2 molecules of the amine to 1 molecule of the aldehyde. These reaction products, however, do not always react quickly or efficiently with sulphide in oil stocks at low temperatures and pressures.

WO 90/07467 discloses the use of alkanolamines reacted with lower aldehydes to form triazines and their use as $H_2S$-scavengers in gaseous or liquid streams of hydrocarbon gases. This type of molecule is typically efficient when used in liquid/gas scrubber towers, by direct atomization into a gas stream or by injection into water streams carrying hydrogen sulphide. However, its effect is decreased markedly when use is attempted in liquid hydrocarbon streams, and may also be decreased when atomised into very dry gas streams.

There are, moreover, problems with the use of triazines. Firstly, in the presence of sea water, which contains calcium ions and dissolved carbon dioxide, their use leads to precipitation of calcium carbonate as scale, and the scale formation can cause severe problems, intractable to the use of conventional scale inhibitors, so that plants need to be regularly flushed out with acid to remove the scale.

The present invention provides a process for reducing the level of hydrogen sulphide in a liquid or gas, by treatment of the liquid or gas with an $H_2S$-scavenger product comprising the reaction product of a carbonyl group-containing compound with an alcohol, thiol, amide, thioamide, urea or thiourea.

Products of the invention avoid or minimise the problems of calcium carbonate mentioned above.

A carbonyl group-containing starting material may contain one or more carbonyl groups, especially one or two carbonyl groups, and comprises aliphatic, alicyclic and/or aromatic moieties, usually aliphatic, alicyclic and/or aromatic hydrocarbon moieties or hydrogen. More especially the compound is aliphatic or cycloaliphatic or contains both aliphatic and cycloaliphatic moieties. Aliphatic or cycloaliphatic groups or moieties may be saturated or unsaturated, but are usually saturated.

Preferably there is used an aldehyde or ketone containing 1 to 10 carbon atoms, for example 1 to 7 carbon atoms. Preferably, the carbonyl compound is an aldehyde, more especially a mono- or di-aldehyde, commonly formaldehyde. (It should be understood that the term "formaldehyde" includes para-formaldehyde, formalin and other chemical forms from which the basic structure HCHO can be derived.) Other suitable aldehydes include, for example, glyoxal, acetaldehyde, propionaldehyde, butyraldehyde and glutaraldehyde. Suitable ketones include, for example, acetone, methyl ethyl ketone, methyl isopropyl ketone, and hexanones and heptanones (having a total of 6 or 7 carbon atoms respectively).

Mixtures of two or more carbonyl compounds, for example two or more of the aldehydes mentioned above, e.g. formaldehyde and one or more other aldehydes, may be used if desired.

An alcohol, thiol, amide, thioamide, urea or thiourea starting material contains one or more hydroxy, thiol, amide, thioamide, urea or thiourea groups, and two or more different groups selected from hydroxy, thiol, amide, thioamide, urea and thiourea groups may if desired be present. The compound comprises aliphatic, alicyclic and/or aromatic moieties, usually aliphatic, alicyclic and/or aromatic hydrocarbon moieties, and more especially the compound is aliphatic or cycloaliphatic, or contains both aliphatic and cycloaliphatic moieties. Other structures, including those with heterocyclic moieties where the hetero atom(s) are selected from oxygen and sulphur, especially non-aromatic heterocyclic moieties, are, however, also possible. Aliphatic or cycloaliphatic groups or moieties may be saturated or unsaturated, but are usually saturated. More especially the compound is aliphatic.

Preferably the starting material is an alcohol or a urea. Preferably the alcohol contains, for example, 1 to 6 hydroxy groups and is, for example, ethylene glycol, propylene glycol, glycerol, ethyl alcohol, methanol, n-butanol, a sugar molecule, or a polyvinyl alcohol of low molecular weight such that the reaction product with the carbonyl starting material remains a liquid. A preferred urea is urea itself, $NH_2CONH_2$. Examples of suitable amides are formamide, acetamide, etc. If desired, however, a corresponding thio derivative of any of the above may be used.

Starting materials may, if desired, contain one or more other functional groups, for example ether, ester, thioether, thioester, fatty acid, nitrate, sulphate or phosphate groups. Thus, for example, the starting material may be diethylene glycol or triethylene glycol, or a starting material containing hydroxy and acid groups, as in castor oil fatty acid, may be used.

Basic groups in the starting material and reaction product should generally be avoided. Thus, the starting material has no or substantially no amine basicity and little or no buffering capacity. Amides and ureas, for example, contain nitrogen atoms, but contain no basic functionality.

Mixtures of two or more such starting materials, for example two or more of the alcohols mentioned, e.g. two or more of the alcohols specifically mentioned, or one or more such alcohols with urea, may be used if desired.

The present invention especially provides a process for reducing the level of hydrogen sulphide in hydrocarbons which comprises treatment of the hydrocarbon with a $H_2S$-scavenger product comprising the reaction product of (i) a carbonyl group-containing compound selected from formaldehyde, glyoxal, acetaldehyde, propionaldehyde, butyraldehyde and glutaraldehyde, with (ii) an alcohol or urea selected from ethylene glycol, propylene glycol, glycerol, diethylene glycol,triethylene glycol, ethyl alcohol, n-butanol, a sugar, a low molecular weight polyvinyl alcohol, castor oil fatty acid and urea, more especially the reaction product of formaldehyde with an alcohol, especially one of those listed above.

The reaction product of formaldehyde and ethylene glycol should especially be mentioned.

Reactions of aldehydes and ketones with alcohols, thiols, amides, thioamides, ureas and thioureas are described in the literature. "Formaldehyde", p 265, Joseph Frederic Walker, reprint 1975, Robert E. Krieger Publishing Company Inc. discloses that hemiformals are obtained when formaldehyde and alcohols are brought together under neutral or alkaline conditions, and that they form readily in the case of primary and secondary alcohols.

Advantageously, the $H_2S$-scavenger product used comprises an acetal, especially a hemiacetal. The acetal may be cyclic, the two acetal oxygen atoms forming part of a ring.

The reactants may be reacted with or without the presence of an acid catalyst in the presence or absence of a solvent, and generally at elevated temperature. Suitable acid catalysts are, for example, sulphuric acid, phosphoric acid and sulphonic acids. Suitable solvents are, for example, hydrocarbons, for example naphtha, xylene or toluene, oxygenated solvents, or water. If desired, the product can be separated from the water or other solvent after reaction. The reaction may be carried out, for example, at a pH in the range of from 2 to 8 or more, more especially at a pH of 4 or above. Particularly in the case of the reaction between an alcohol or thiol and a carbonyl group-containing compound, any acid catalyst is preferably neutralised after reaction. After reaction if necessary the pH of the product may be raised, for example by the addition of sodium hydroxide, potassium hydroxide, sodium carbonate or potassium carbonate. Preferably the pH of the final product is in the range of from 4 to 11, especially, for example, in the range of from 10 to 10.5. Buffered products, containing for example carbonates, phosphates or borates, should especially be mentioned.

The reactants may, for example, be reacted in a substantially stoichiometric ratio. However, other ratios may be used, and, for example, it is not necessary to proceed to full reaction of all hydroxy, thiol, amide, thioamide, urea or thiourea groups. For example, with ethylene glycol as starting material, the reaction is preferably carried out so that both hydroxy groups are reacted, or alternatively less than the stoichiometric amount of carbonyl compound may be used. The molar ratio of formaldehyde to ethylene glycol may, for example, be up to 2:1. Reaction of a substantially 2:1 or less than 2:1, e.g. substantially 1:1 molar mixture of formaldehyde:ethylene glycol may especially be mentioned. With, for example, a sugar, reaction of only some hydroxy groups may be sufficient. When a stoichiometric excess of the alcohol, thiol, amide, thioamide, urea or thiorea is used the presence of residual free carbonyl compound in the final product may be reduced to extremely low levels.

As will be clear to the person skilled in the art, the structure of the reaction product or products will depend, inter alia, on the stoichiometry of the products reacted together.

With ethylene glycol and formaldehyde the reaction may be carried out to produce ethylene glycol hemiformal Ia

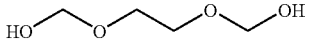

(also known as [1,2-ethanediylbis(oxy)]-bis-methanol or 1,6-dihydroxy-2,5-dioxahexane). Other products may also be formed. Oligomeric compounds of different chain lengths should be mentioned.

Typical syntheses in the literature indicate that one mol of ethylene glycol can be reacted with two mols of formaldehyde in the presence of mineral acid (0.1–10% or <0.1%) as a catalyst. Water may be removed by conventional or azeotropic distillation in order to drive the reaction further to completion. We have also found that reaction may readily be carried out without catalyst. The final product may be neutralised or made alkaline in order to improve product stability. As mentioned above, mixtures comprising hemiformals may be produced.

With urea and formaldehyde the reaction product comprises preferably dimethylolurea (also known as N,N-bis-(hydroxymethyl)urea)

Ib

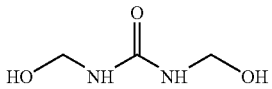

Butylformal of formula

Ic

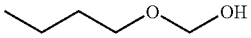

(also known as butoxymethanol) should also be mentioned.

The products Ia–Ic are known and/or are available commercially. Ethylene glycol hemiformal and its admixture with dimethylolurea are known as bactericidal agents, for example for use in cutting fluids for metal machining. Generally for such purposes the products are used in concentrations of less than 5% by weight, for example in concentrations of 0.01 to 0.2% by weight, although concentrations of up to 3% or even 4% have been used in some cases. There has been no prior disclosure of such materials for scavenging hydrogen sulphide.

The use of a mixture of scavenging products of the invention, for example a mixture of an alcohol-carbonyl compound reaction product and a urea-carbonyl compound reaction product, more especially a mixture of ethylene glycol-formaldehyde and urea-formaldehyde reaction products, may be mentioned. For example, the mixture may comprise a mixture of the above two reaction products Ia and Ib. The reaction products may be used, for example, in a weight ratio of 1:99 to 99:1.

The present invention especially provides a process for reducing the level of hydrogen sulphide in hydrocarbons by treatment of the hydrocarbon with a formaldehyde-hydroxyl reaction product and/or formaldehyde-urea reaction product, the starting materials being substantially amine-free.

The use of the dioxolane product

II

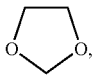

derivable from the reaction of ethylene glycol with formaldehyde in a ratio of substantially 1:1 with the elimination of water, should also be mentioned.

As mentioned, products of the invention have the advantage of avoiding or minimising the problems of calcium carbonate scale formation encountered with the use of triazines. The pH remains substantially stable on addition of the scavenging product.

Furthermore, it has unexpectedly been found that when the amine-free reaction products are used problems associated with crystalline hydrates in gas pipelines are avoided or minimised. Any water in the gas pipeline can react with methane gas to form methane hydrates, which are both explosive and flammable. Many scavenging products, however, including triazine, require the presence of water for efficient scavenging action, and therefore for hydrate control water must be removed before the gas is fed to the pipeline (which minimises the time available for the scavenging reaction) and/or a hydrate-control agent, for example glycol or ammonia, is used. However, with the reaction products of the invention mentioned above water is not essential for efficient scavenging and by using water-free solvents the crystalline hydrate problem can be minimised or avoided.

In addition, in comparison with triazines which react with hydrogen sulphide to produce trithiane, relatively insoluble in methanol and ethanol, we have found, for example, that reaction products of the invention such as the reaction product of ethylene glycol and formaldehyde reacts with hydrogen sulphide to produce a structure which is soluble in lower alcohols such as methanol and ethanol, and therefore leads to fewer problems in use.

Products comprising ethylene glycol hemiformal, butylformal and ethylene glycol hemiformal-dimethylolurea mixtures have, for example, given excellent results. Reaction products of glycerol and glucose with formaldehyde have also been tested as well as, for example, the ethylene glycol-formaldehyde reaction products. Excellent results have been obtained. These products show reduced or no pH effect on the systems, high efficiency, reasonable cost, and reduction of free aldehyde in the chemicals and the hazards which accompany their presence.

The process is especially suitable for the treatment of a hydrocarbon stream. The hydrocarbon may be a liquid hydrocarbon or a hydrocarbon gas and is operated to remove or reduce the levels of $H_2S$ in such products. Levels of other mercaptans or other contaminants may also be reduced. Thus, for example, the process may be used for "sweetening" of sour natural gas or oil or other gaseous or liquid fuels, for example produced natural gas or crude oil streams, or streams of refined fuels, including liquefied petroleum gas, e.g. butane, systems, or coal gas or town gas streams, or for the treatment of such material contained in storage tanks or vessels. The treatment of sewage gas should also be mentioned. Preferably, the process is used to reduce the hydrogen sulphide level in a gas, for example a gas containing water and/or a liquid hydrocarbon.

The product may be utilised, for example, by direct injection (in undiluted form and without the use of special ancillary equipment such as bubble towers) into crude oil at a well head or into a pipeline, or by direct atomisation into a stream of hydrocarbon gas. It may also be dosed directly into refined hydrocarbon fuels, either gaseous or liquid, or into refinery feedstocks. Alternatively, the product may, for example, be utilised dissolved or diluted in, for example, hydrocarbons, alcohols (including glycols) or water.

It is usually convenient to dissolve the reaction product in a suitable solvent for use. Typical solvents which can be used effectively include toluene, xylene, heavy aromatic naphtha, de-aromatised petroleum distillate, water and mono-alcohols and di-alcohols having 1 to 10 carbon atoms in the structure, e.g. methanol, ethanol or glycol, and mixtures of the above; as will be readily understood in the art, however, the solvent should be chosen to avoid toxicity and flammability hazards. Suitably the solutions used may have, for example, a concentration of from 10 to 95% by weight, for example at least 50%, often at least 70%, and for example up to 90%, by weight.

Accordingly, the present invention provides an $H_2S$-scavenger product comprising at least 10% by weight of reaction product of the invention in solution in a hydrocarbon or an alcohol or water. Solutions in methanol or ethanol should especially be mentioned.

We have also found that the use of a reaction product of the invention together with an amine can provide additional advantages.

In some cases, the use of the reaction products of the invention has been seen to cause an objectionable precipitate of incompletely defined identity. Results to date suggest that sparingly soluble ringed sulphur compounds of 5, 7 and 8 ring atoms are possibly being formed. We have found that addition of methanol, ethanol and amine were useful. Methanol and ethanol were helpful in keeping the ring compounds in solution. We have also found that adding small quantities of amines, for example monoethanolamine, serves to reduce or eliminate the solids problems. Addition of alkanolamine to the formal reaction products used resulted for example in stable formal mixtures which react with hydrogen sulphide but have a decreased tendency toward precipitation. In some cases this addition actually improves the efficiency of reaction of the primary acetal or hemiacetal or other reaction product.

The amine should generally be water-soluble. The amine may be, for example, monoethanolamine, diethanolamine, triethanolamine or other oxygen-containing amine, for example a morpholine, e.g. the commercial product Amine C6 or C8 (a morpholine residue available from Huntsman Chemicals, UK), a triazine, for example 1,3,5-tri-(2-hydroxyethyl)hexahydro-s-triazine ("monoethanolamine triazine"), a bisoxazolidine, for example N,N'-methylenebisoxazolidine, or a straight chain $(C_1–C_4)$alkylamine, e.g. methylamine or butylamine, a di-$(C_1–C_4)$alkylamine or a tri-$(C_1–C_4)$alkylamine. In contrast to the reaction products of the invention, the amine will have a higher basicity and has buffering capacity.

The amount of amine may vary with conditions of use, and according, for example, to the amine itself, but may be, for example, up to 40%, and especially at least 5%, especially from 5 to 30%, more especially from 10 to 20%, e.g. substantially 10%, by weight, calculated on the total product, including any solvent and including amine.

The reaction product solution may itself be made up, for example, of

- ❖70% reaction product
- ❖25.9% water
- ❖4.1% sodium hydroxide solution of 5% strength, and, for example, a scavenger product of the invention may comprise

- 0 to 40% amine, e.g. monoethanolamine or monoethanolamine triazine, especially the amine percentages mentioned above, and
- 60 to 100% reaction product solution More especially, whatever the proportion of reaction product present in the reaction product solution, the relative proportions of reaction product and amine are substantially equivalent to the relative proportions in the reaction product solution shown above.

Thus the present invention also provides an $H_2S$-scavenger product comprising (a) a reaction product derivable by reaction of a carbonyl group-containing compound with an alcohol, thiol, amide, thioamide, urea or thiourea, said alcohol, thiol, amide, thioamide, urea or thiourea having no amine function, and (b) an amine, for example monoethanolamine or monoethanolamine triazine, for example in an amount of

- at least 60%, preferably at least 84%, e.g. 85 or 86%, by weight of (a), and
- up to 40%, preferably up to 26%, e.g. 14 or 15%, by weight of (b), calculated on the amount of (a) and (b) only.

There may, for example, be 7 to 40%, e.g. up to 30%, often 14 to 26%, by weight of amine in the mixture, calculated on the weight of (a) and (b).

The following Examples illustrate the invention.

BRIEF DESCRIPTION OF THE DRAWINGS

The following examples make reference to the drawings in which.

EXAMPLES

Figure 1:
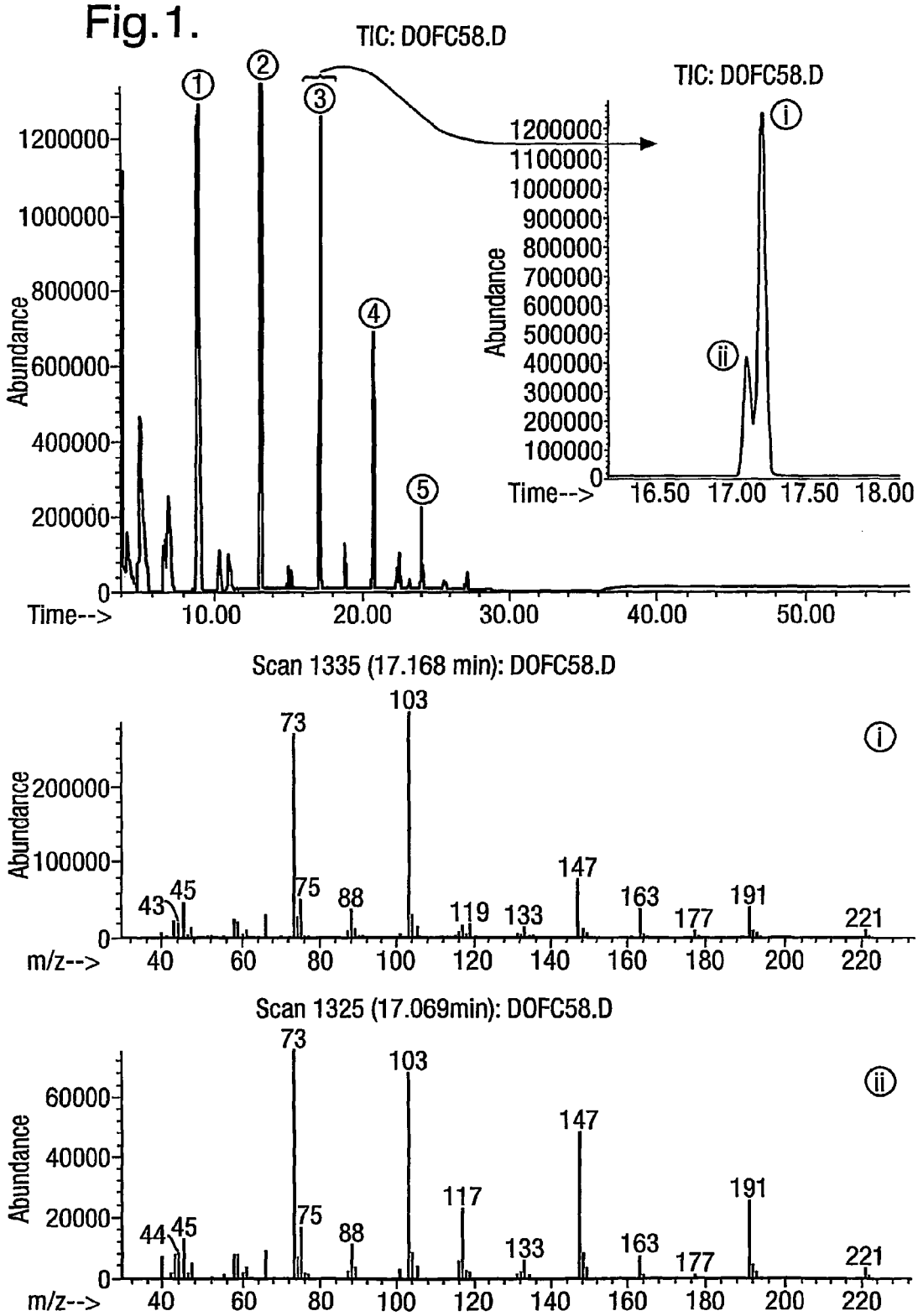
FIG. 1 is a Total Ion Chromatogram presentation of data obtained from a gas chromatography/mass spectrometer analysis of the compounds created in Examples.

Preparation Examples (A) Preparation of formaldehyde-ethylene glycol reaction product (Reaction of 2 mols HCHO to 1.05 mols ethylene glycol)

| Component | % by weight | Mols |
|---|---|---|
| Monoethyleneglycol (tech: >98%) | 35.60 | 0.574 |
| Formalin (~51% w/w) | 64.4 | 1.094 |
| Total | 100.00 | |

Mol ratio aldehyde/alcohol: 1.905

The glycol is charged to a stirred reactor and the formalin is added over a period of approximately 30 minutes. The reaction mixture is warmed with stirring for 2 hours at 65° C.

Analysis

The samples were derivatised using N,O-bis(trimethylsilyl)trifluoroacetamide (BSTFA) with 1% trimethyl-chlorosilane (TMCS). The derivatisation replaces the hydroxyl protons with trimethylsilyl groups, to make the molecules more volatile and better suited for gas chromatographic analysis.

BSTFA/TMCS reagent (100 μl), pyridine (10 μl) and sample (3 μl) were transferred to a 4 ml sample vial. The vial was sealed with a screw cap with a PTFE-lined septum and heated in an incubator at 80° C. for 30 minutes. The samples were diluted to approx 3 ml with dichloromethane prior to GC/MS analysis.

Analysis was by gas chromatography/mass spectrometry.

| Gas chromatograph | Hewlett-Packard 5890A |
|---|---|
| Column | HP-5 MS, 25 m, 0.20 mm i.d., film thickness 0.33 μm |
| Column temperature | 35° C. (4 min), incr. 6° C./min to 300° C. |
| Injector | Splitless (40 sec), 250° C. |
| Injection volume | 1.0 μl |
| Carrier gas | He, 1.0 ml/min |

| Mass spectrometer | Hewlett Packard 5970B |
|---|---|
| Ionisation | Electron Impact, 70 eV |
| Interface | 280° C. |
| Full scan | 35–500 z/e |

Figure 2:
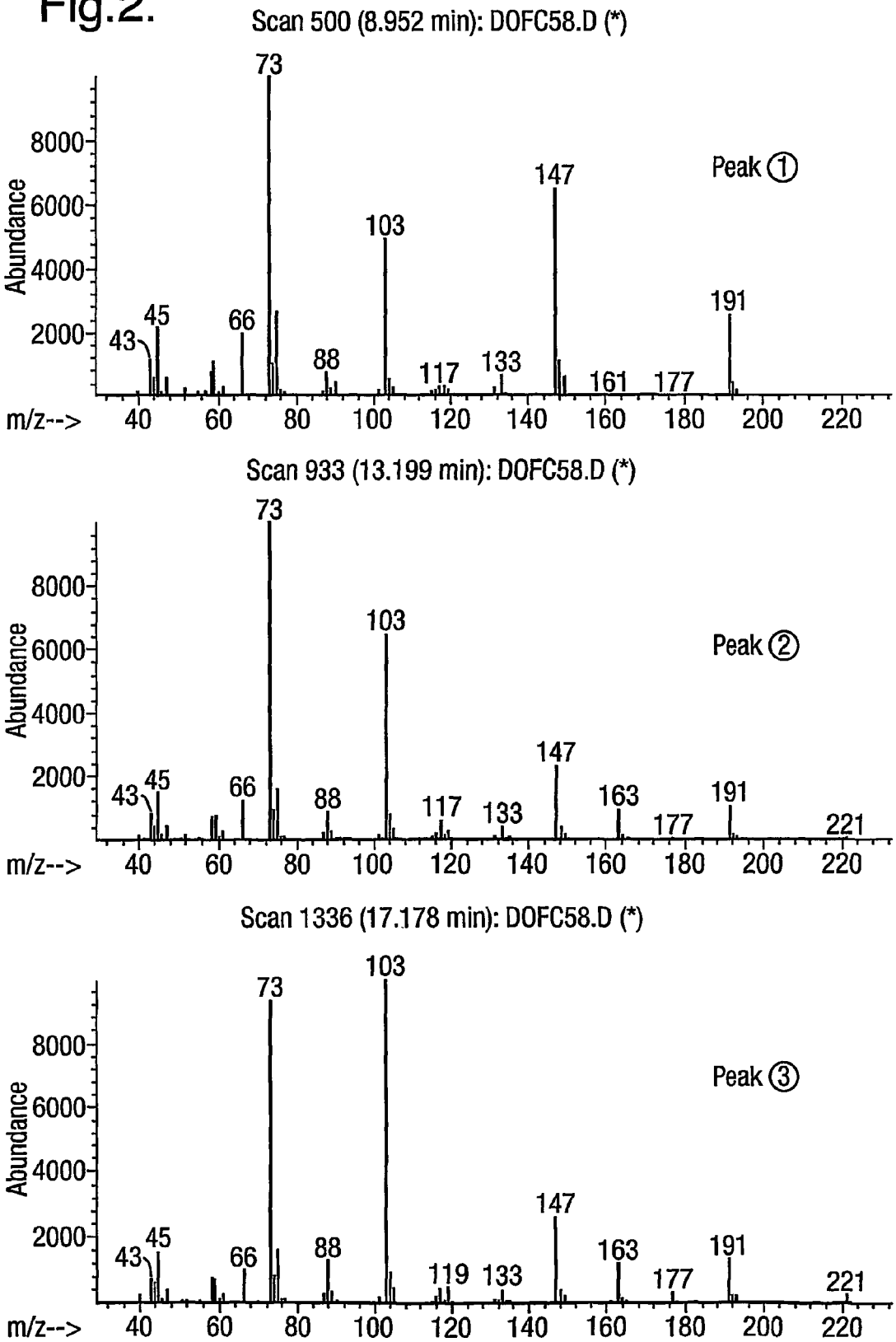
FIG. 2 is a graphical representation of mass spectrometry data obtained from peaks 1, 2 and 3 identified in FIG. 1.

A series of oligomeric compounds appears to have been formed. A Total Ion Chromatogram (TIC) is given in FIG. 1 and mass spectrometry data for peaks 1, 2 and 3 is shown in FIG. 2. The compounds 1–5 appear to be oligomers with increasing chain length. A closer look at the peaks shows overlap of two compounds in each of them. These two-compounds have different mass spectra, even though most of the fragment ions are the same. Some possible structures of the main peak ((i) of peak 3 in FIG. 1) are given in Table 1 below.

Figure 3:
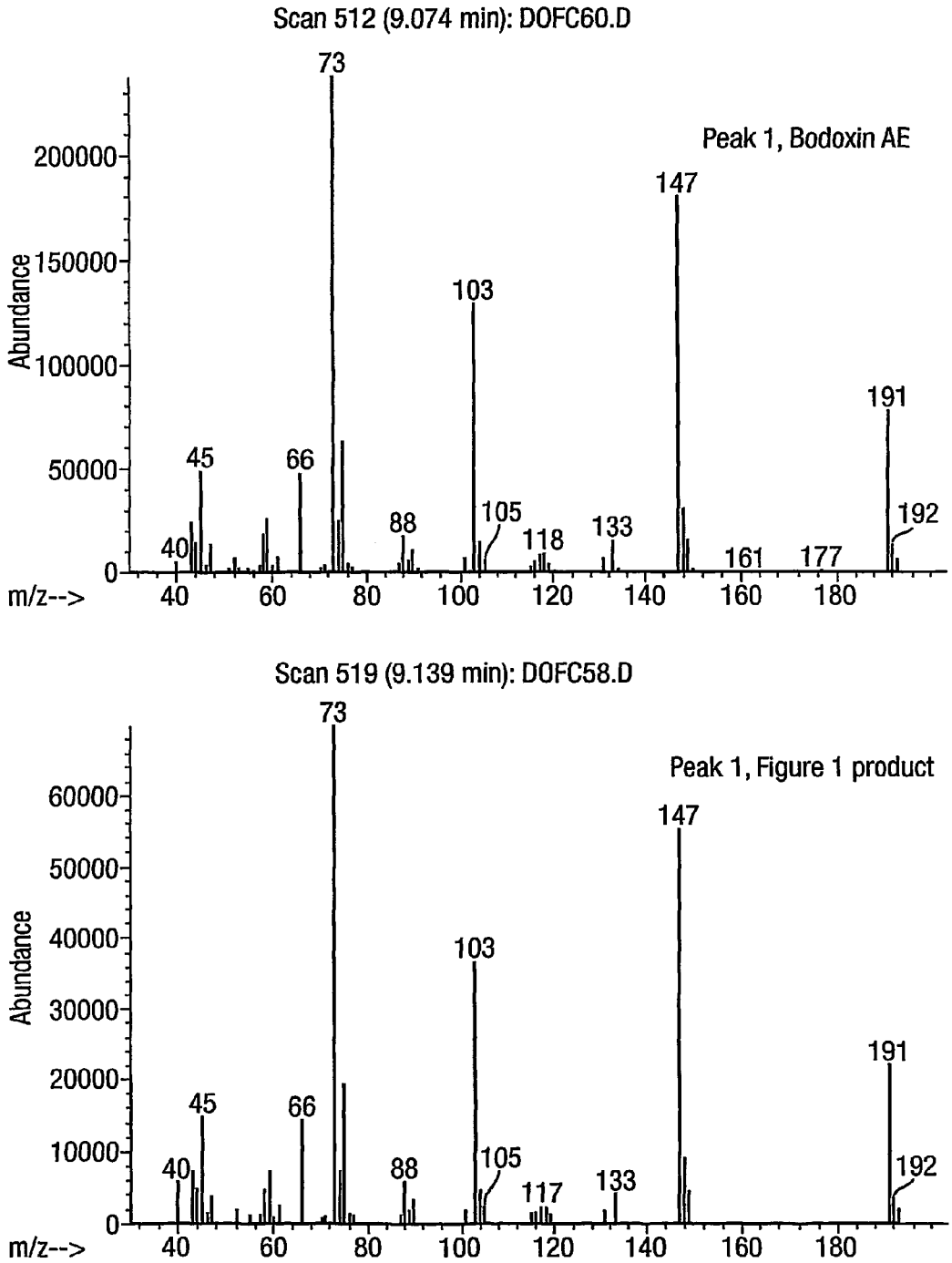
FIG. 3 is a graphical representation of mass spectrometry data obtained from peak 3 identified in FIG. 1.

Mass spectrometry of peak i (FIG. 3*a*) shows a major fragment ion of m/z 191 and no major fragment ion of m/z 117. Work to date suggests that structure (IV) appears to be the most probable structure from the MS results. All major fragment ions (m/z 73, 103, 147, 191) in the mass spectrum can be identified from this structure. The TMS groups have replaced the hydroxyl protons during derivatisation. The minor peak ((ii) in FIG. 1) is most probably identical to structure (III). All major fragment ions (m/z 73, 103, 117, 147, 191, 221) in the mass spectrum can be identified from this structure.

Figure 4:
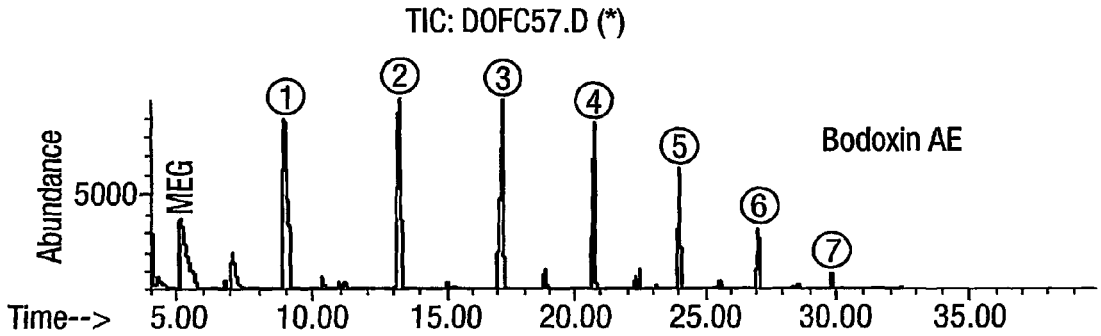
FIG. 4 is a graphical representation of mass spectrometry data obtained from a commercial sample of Bodoxin AE product.
Figure 4:
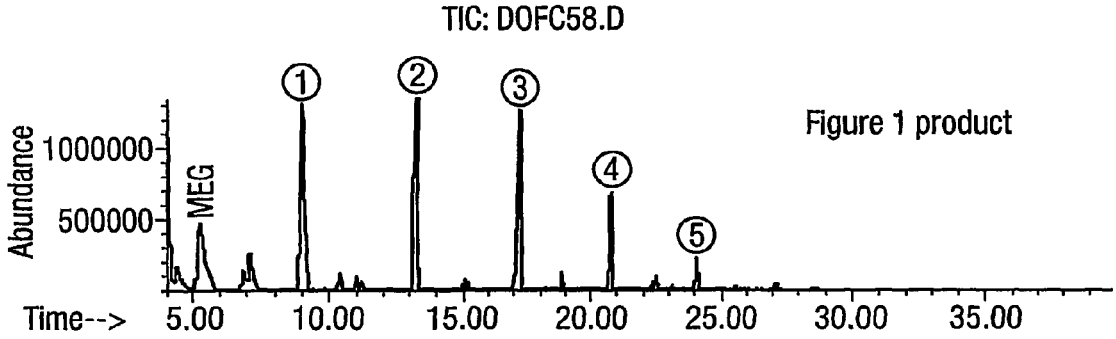

Comparisons were made with the commercially available Bodoxin AE product. This was similar in composition (FIGS. 3 and 4) and contained a range of aldehyde/alcohol reaction products.

TABLE 1

(I)

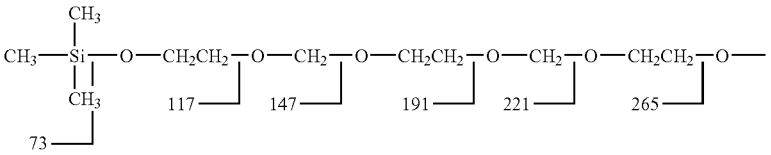

TABLE 1-continued

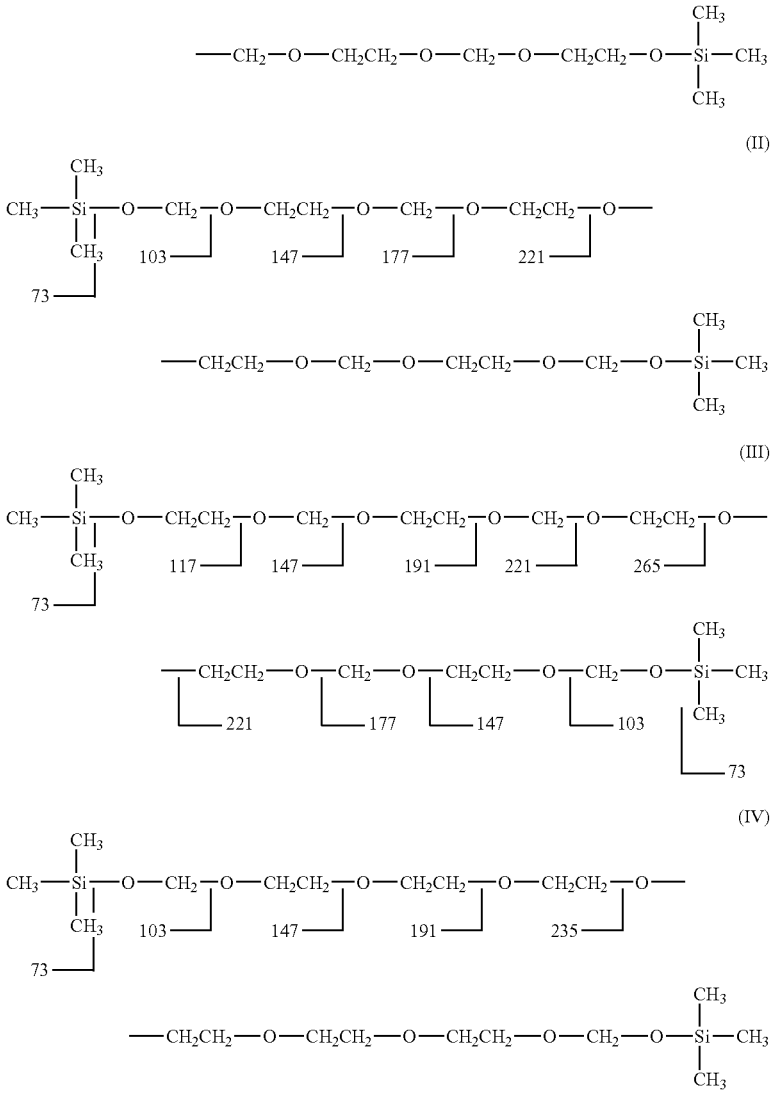

(B) Preparation of formaldehyde-glycerol reaction product (Reaction of 2 mols formaldehyde to 1.0 mols glycerol)

| Component | % by weight | Mols |
|---|---|---|
| Glycerol (technical) | 43.89 | 0.477 |
| Formalin (~51% w/w) | 56.11 | 0.953 |
| Total | 100.00 | |

Mol ratio aldehyde/alcohol: 2.000

The glycerol is charged to a stirred reactor and the formalin is added over a period of approximately 30 minutes. The reaction mixture is warmed with stirring for 2 hours at 65° C.

In this case, the literature is quite specific about the compounds which are formed, and it does not appear to be advantageous to attempt to react aldehyde moieties to alcohols moieties on a 1:1 basis. A range of reaction by-products results, all of which are embodiments of the desired chemistry.

(C) Preparation of formaldehyde-glucose reaction product (Reaction of 2 mols formaldehyde to 1.0 mols glucose)

| Component | % by weight | Mols |
|---|---|---|
| Glucose, food grade | 60.47 | 0.336 |
| Formalin (~51% w/w) | 39.53 | 0.671 |
| Total | 100.00 | |

Mol ratio aldehyde/alcohol: 2.000

The glucose is charged to a stirred reactor and the formalin is added over a period of approximately 30 minutes. The reaction mixture is warmed with stirring for 2 hours at 65° C.

The reaction conditions described are typical, but are by no means limiting. Extensive work with monoethylene glycol has shown that reaction products are formed over a wide range of reaction times and temperatures. Both acid catalysts and alkaline catalysts were investigated, and reactions were possible over a fairly wide range of pH values. In general, it appears that high temperatures are not needed; temperatures of 100° C. and greater can be tolerated. Also, pH ranges from below 4.0 to over 8.5 were evaluated. Reaction products could be made repeatedly and reproducibly within this range. Below pH 4 the likelihood for corrosion in production equipment, as well as the formation of other possible species, makes such conditions less desirable. In like manner, reaction can be carried out at pH values of over 8.5, but possible side reactions, such as Cannizzaro condensations, may detract.

$H_2S$-scavenging Tests

Many different tests are available to determine the efficiency of products in the removal of sulphide compounds including $H_2S$ from oil streams and gas streams. Since the content of the sulphide in the gas phase above the hydrocarbon liquid is proportional to the concentration of the sulphide in the hydrocarbon layer, then a two-phase system can be used, where the test product is dosed into the sulphide-bearing hydrocarbon and the change in sulphide in the vapour phase is detected.

The detection in the vapour phase may be carried out by the use of electrochemical cells, by collection of the gas in a suitable analytical gas train, by the use of absorptive media consisting of a calibrated glass or plastic tube containing an inert substrate bearing lead compounds which are calibrated to give a direct reading of sulphide content, or by any other method based on sound and analytical techniques.

EXAMPLE 1

An electrolytic cell was used which reacts with hydrogen sulphide in the vapour phase and generates an electrical output proportional to the sulphide level. The electrical output is digitised and recorded using sampling software and a personal computer. Data can be computed quickly and accurately by this technique, and computer processing of data yields efficient comparison with other species under test.

Figure 5:
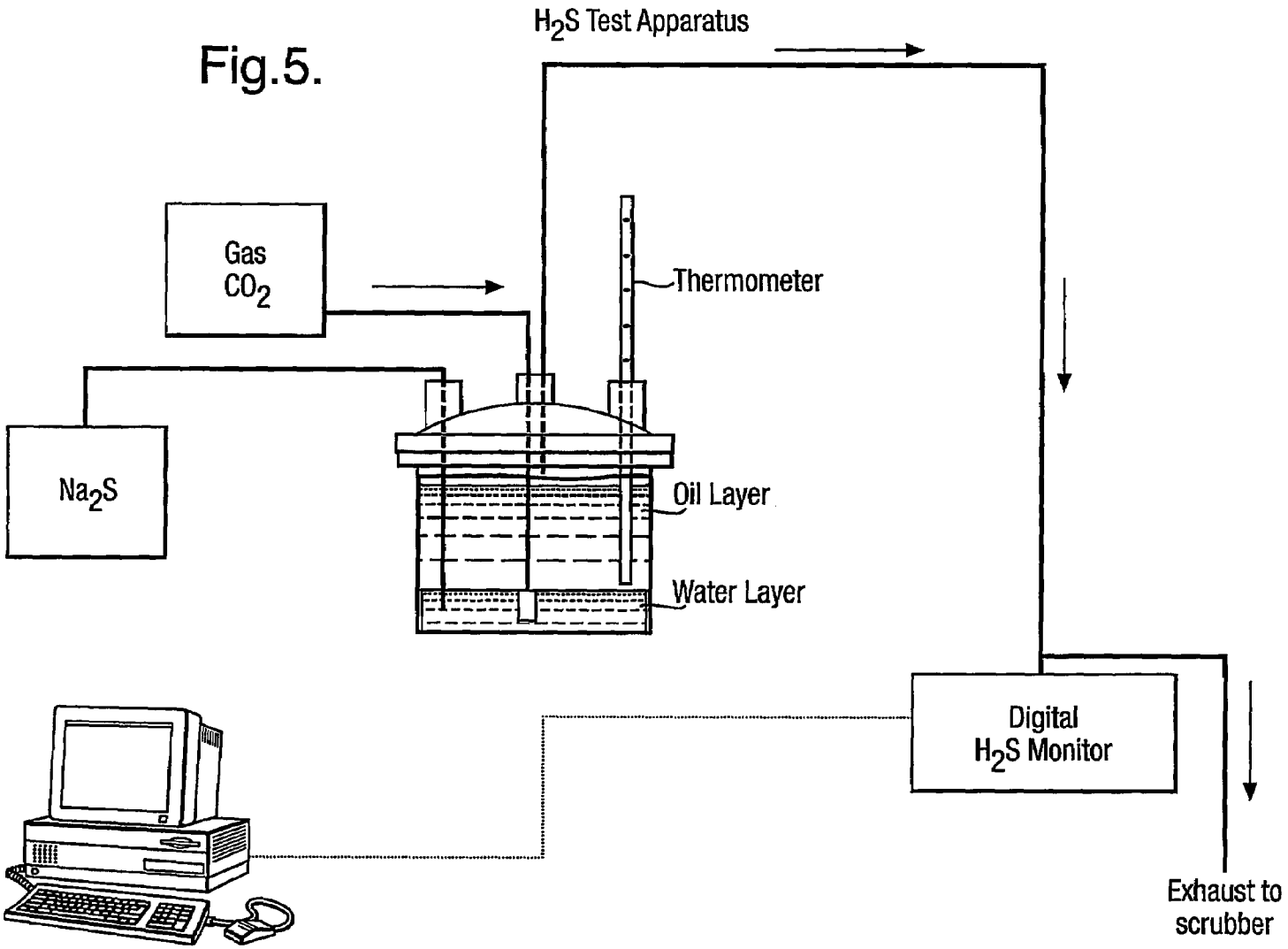
FIG. 5 is an illustrative drawing of the test apparatus utilized in Example 1.

The test apparatus used is shown in FIG. 5 of the accompanying drawings. Hydrogen sulphide was generated in situ by feeding sodium sulphide and gaseous carbon dioxide into a water layer below the oil layer.

Tests were carried out using

- ethylene glycol hemiformal available as Bodoxin AE from Bode Chemie GmbH
- the mixture of ethylene glycol hemiformal and dimethylolurea available as Bodoxin AH from Bode Chemie GmbH
- butyl formal used in solution in butanol in comparison with
- reference products
  - (i) the well-known H2S-scavenger, monoethanolamine triazine, formed by the reaction of 1 mol of formaldehyde with 1.06 mol of monoethanolamine according to the method of WO/07467, and
  - (ii) formalin.

Figure 6A:
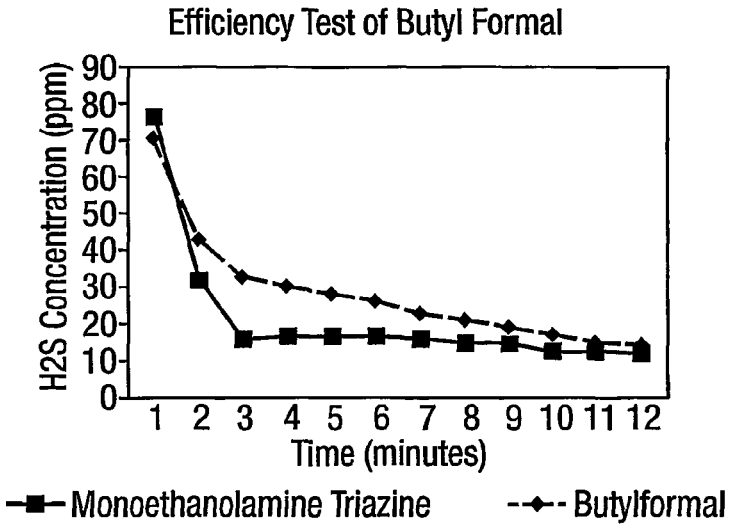
FIG. 6 is a graphical representation of the test results from Example 1.
Figure 6B:
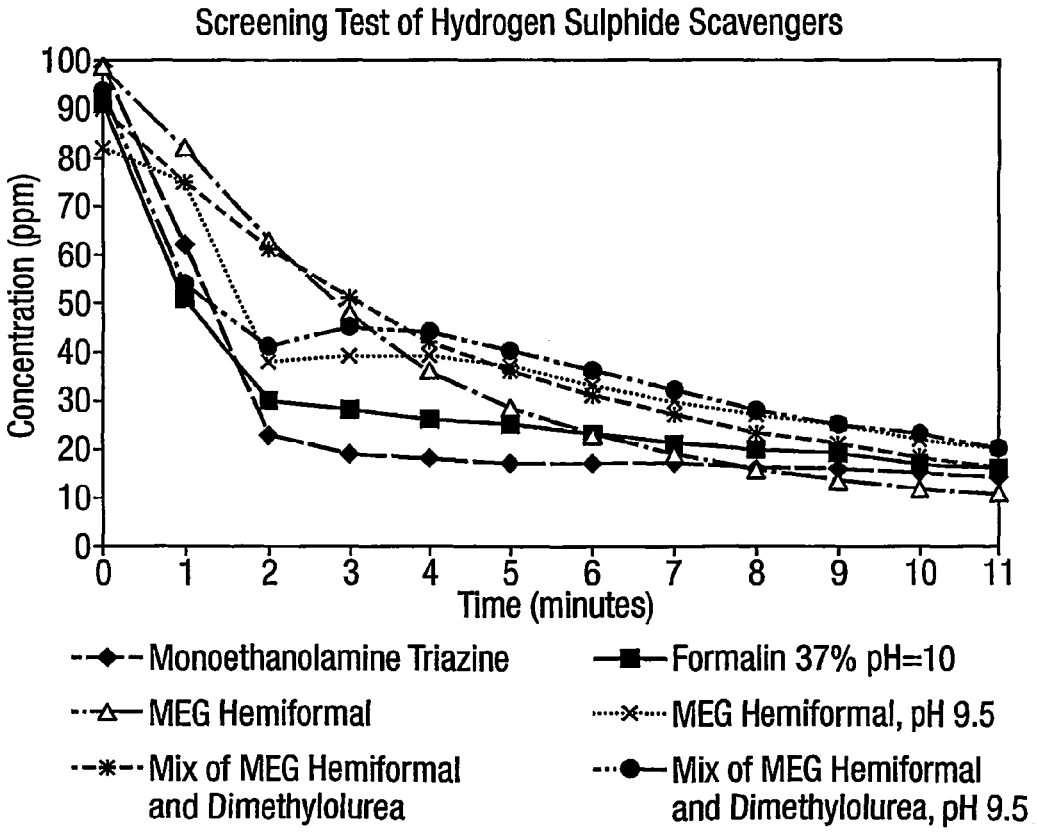

Results are shown graphically in FIGS. 6A and 6B of the accompanying drawings. Tests with the mixture of monoethylene glycol hemiformal and dimethylolurea were carried out with the Bodoxin AH as supplied (approximately 95% in water, pH 4), and also with the addition of a suitable buffering agent to give pH 9.5.

In general, reaction rates using higher pH products were faster than those obtained using unbuffered products.

EXAMPLE 2

Products A, B and C as prepared above, with optional additions indicated below, were tested under laboratory conditions for efficacy as $H_2S$-scavengers. Monoethanolamine triazine, the reaction product of approximately 45–50 mol % formaldehyde and 55–45 mol % monoethanolamine was used as reference.

A glass cell was fitted with a gas dispersion (frit) tube, and accurately measured quantities of the product and water were added to the cell. A stream of gas containing $H_2S$ was then passed at a carefully controlled rate through the product/water charge. The content of $H_2S$ in the gas leaving the cell is measured, or detected, using either an electronic $H_2S$ detector, based on an electrochemical cell, such as is provided by Draeger or others, or alternatively, the gas can be monitored by use of indicating $H_2S$ absorption tubes such as are supplied by Draeger or others, wet or colorimetric colour methods, or similar.

The start time is recorded upon initiation of flow through the cell, and the end time is recorded when the level of $H_2S$ in the cell effluent has reached a predetermined value. In our tests the entering $H_2S$ level was 200 ppm in the test, and the test was stopped when the level of $H_2S$ in the effluent reached 10 ppm. Under these conditions test run times of ca. 4–5 hours are seen with the reference product.

(The details of the quantity and ratio of liquids chosen can be varied to compensate for a range of $H_2S$ concentrations in the gas phase, and to accommodate convenient time spans.)

Test data

| Formulation tested | Elapsed time, mins | Relative efficiency | Comments |
|---|---|---|---|
| Blank | 0 | | |
| Reference triazine[1] | 248 | 100 | |
| Product A[1] | 189 | 76 | Some delayed precipitation |
| Product A[1] + 2% NaOH[2] | 300 | 121 | Slight delayed precipitation |
| Product A[1] + 10% monoethanolamine[3] | 336 | 135 | Insignificant precipitation |
| Product B[1] | 205 | 83 | Reaction rate appears slow. Capacity not reached |
| Product C[1] | 260 | 105 | No precipitation at all |

[1]used as aqueous solutions: triazine approx 50–60%; products A, B and C as prepared above

[2]2% NaOH, calculated on total wt of product A solution and NaOH addition; added as solution in water (4–5%)

[3]10% monoethanolamine, calculated on total wt of product A solution and monoethanolamine addition.

The tests showed clearly that increase in pH, whether by alkanolamine or mineral alkali, improved the solubility of the reaction by-product without negatively affecting the stability or scavenging ability of the product.

FURTHER PREPARATION EXAMPLES (D) Preparation of formaldehyde-ethylene glycol reaction product (Reaction of 1 mol HCHO to 1.05 mols ethylene glycol)

Monoethylene glycol (1.05 mol) was mixed with formaldehyde (1 mol, 50% solution) and the pH was adjusted with phosphoric acid to pH 2.5. The mixture was heated to 65° C., and kept there for 2 hours. The end pH was recorded as 2.5. Gas chromatography and mass spectrometry results showed a series of oligomeric compounds as in A above.

(E) Preparation of formaldehyde-diethylene glycol reaction product (Reaction of 2 mols formaldehyde to 1.05 mols diethylene glycol)

Diethylene glycol (1.05 mol) was mixed with formaldehyde (2 mol, 50% solution) and the pH was adjusted with sodium hydroxide solution (5%) to pH 8. The mixture was heated and stirred for 2 hours at 65° C. The end pH was recorded as 7.

This sample shows a series of oligomeric compounds different from the monoethylene glycol samples A above. The TIC is given in FIG. 7. Once again there are overlapping peaks in the chromatogram as exemplified in FIG. 7. These two compounds have different mass spectra, even though most of the fragment ions are the same.

Figure 7:
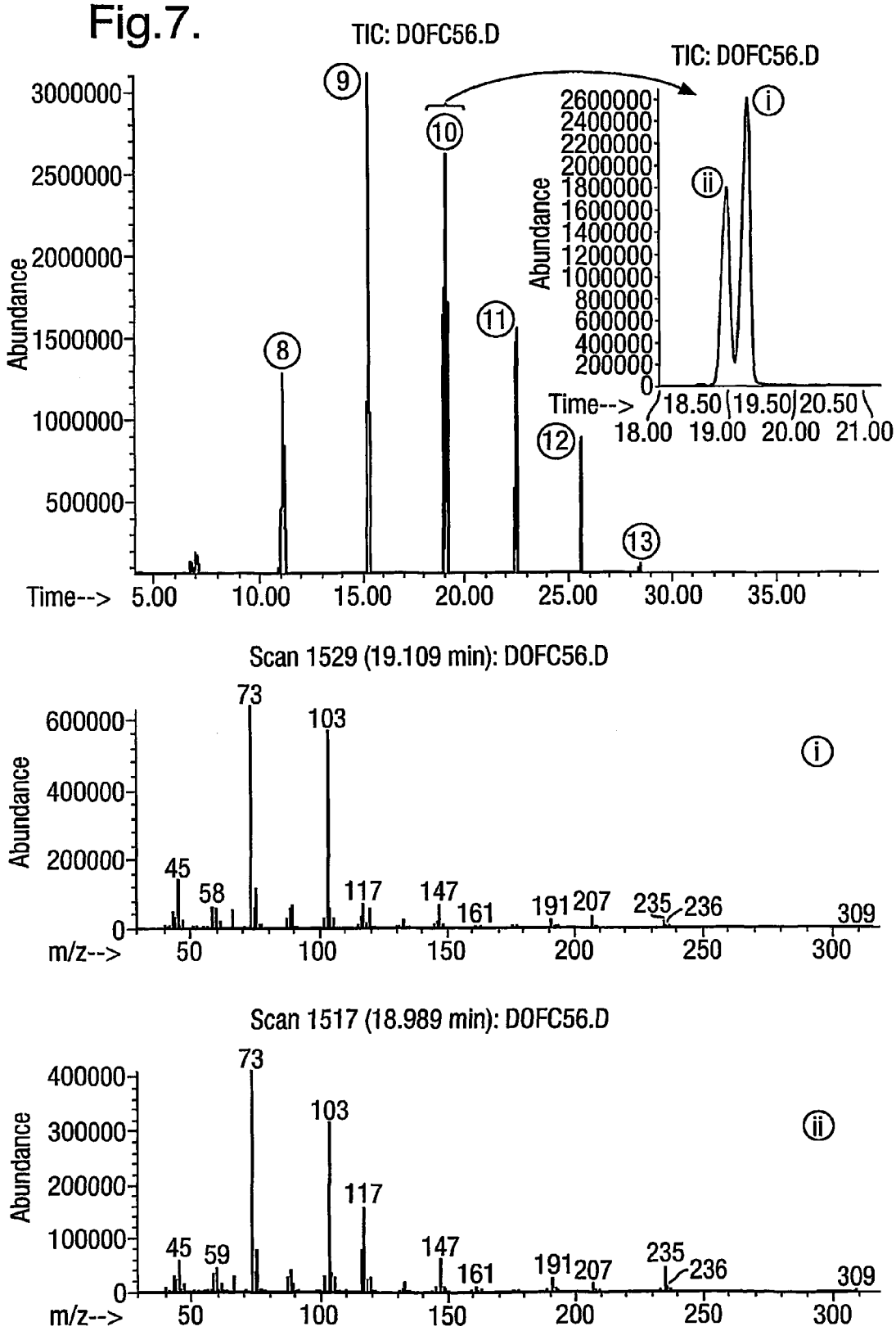
FIG. 7 is a Total Ion Chromatogram presentation of data obtained from a gas chromatography/mass spectrometer analysis of the compounds created in the Further Preparation Examples.

Possibl structures for the derivatised products in the main and minor peaks (i) of peak 10 in FIG. 7 are structures (V) and (VI), respectively.

(V)

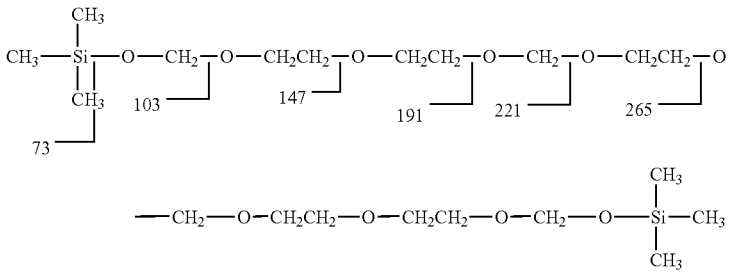

(VI)

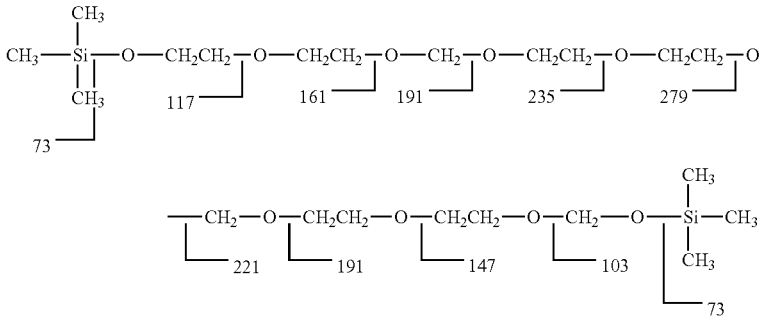

Reaction Products D and E also showed good scavenging properties.

The invention claimed is:

1. A process for reducing the level of hydrogen sulphide in a fluid, the process comprising: contacting the fluid with a hydrogen sulphide scavenging agent, wherein the hydrogen sulphide scavenging agent is composed of a solvent and 1,6-dihydroxy-2,5-dioxahexane.

2. A process as claimed in claim 1, wherein the hydrogen sulphide scavenging agent the solvent is selected from the group consisting toluene, xylene, heavy aromatic naphtha, de-aromatized petroleum distillate, water, mono-alcohols and di-alcohols having 1 to 10 carbon atoms, and mixtures of these.

3. A process as claimed in claim 2, wherein the reaction product is present in an amount of at least 10% by weight in solution.

4. A process as claimed in claim 1, wherein the hydrogen sulphide scavenging agent includes an amine.

5. A process as claimed in claim 4, wherein the hydrogen sulphide scavenging agent includes an amine.

6. A process as claimed in claim 4, wherein the hydrogen sulphide scavenging agent includes monoethanolamine.

7. A process as claimed in claim 1, wherein the solvent is water and wherein the water has a pH in the range of from 4 to 11.

8. A process as claimed in claim 7, wherein the solvent is water and wherein the water has a pH in the range of from 10 to 10.5.

9. A process as claimed in claim 1, wherein the hydrogen sulphide scavenging agent is used to reduce the level of hydrogen sulphide in a fluid comprising of liquid or gaseous hydrocarbon.

10. A process as claimed in claim 1, wherein the hydrogen sulphide scavenging agent is used to reduce the hydrogen sulphide level in a fluid that is a gas.

11. A process as claimed in claim 10, wherein the gas contains water or a liquid hydrocarbon.

12. A process as claimed in claim 1, wherein the hydrogen sulphide scavenging agent is used to reduce the level of hydrogen sulphide in a fluid selected from the group consisting of natural gas or oil.

13. A process as claimed in claim 1, wherein the hydrogen sulphide scavenging agent is used to reduce the level of hydrogen sulphide in a fluid that is a refined fuel.

14. a process as claimed in claim 1, wherein the hydrogen sulphide scavenging agent is used to reduce the level of hydrogen sulphide in a fluid comprising sewage gas.

15. A process as claimed in claim 1, wherein the hydrogen sulphide scavenging agent further comprises N.N-bis-(hydroxymethyl)urea.

16. A process as claimed in claim 1, wherein the hydrogen sulphide scavenging agent further comprises butoxymethanol.

17. A process for reducing the level of hydrogen sulphide in a fluid, the process comprising: contacting the fluid with a hydrogen sulphide scavenging agent, wherein the hydrogen sulphide scavenging agent is composed of: a solvent; 1,6-dihydroxy-2,5-dioxahexane; and N.N-bis-(hydroxymethyl)urea.

18. A process as claimed in claim 17, wherein the hydrogen sulphide scavenging agent further comprises butoxymethanol.

19. A process as claimed in claim 17, wherein the solvent is selected from the group consisting toluene, xylene, heavy aromatic naphtha, de-aromatized petroleum distillate, water, mono-alcohols and di-alcohols having 1 to 10 carbon atoms, and mixtures of these.

20. A process as claimed in claim 17, wherein the hydrogen sulphide scavenging agent is present in an amount of at least 10% by weight in the solution.

21. A process as claimed in claim 17, wherein the hydrogen sulphide scavenging agent is substantially water-free.

22. A process as claimed in claim 17, wherein the hydrogen sulphide scavenging agent includes an amine.

23. A process as claimed in claim 17, wherein the solvent is water and wherein the water has pH in the range of from 4 to 11.

24. A process as claimed in claim 17, wherein the solvent is water and wherein the water has a pH in the range of from 10 to 10.5.

25. A process as claimed in claim 17, wherein the hydrogen sulphide scavenging agent is used to reduce the level of hydrogen sulphide in a fluid comprising of the liquid or gaseous hydrocarbon.

26. A process as claimed in claim 17, wherein the hydrogen sulphide scavenging agent is used to reduce the hydrogen sulphide level in a fluid that is a gas.

27. A process as claimed in claim 26, wherein the gas contains water or a liquid hydrocarbon.

28. A process as claimed in claim 17, wherein the hydrogen sulphide scavenging agent is used to reduce the level of hydrogen sulphide in a fluid selected from the group consisting of natural gas or oil.

29. A process as claimed in claim 17, wherein the hydrogen sulphide scavenging agent is used to reduce the level of hydrogen sulphide in a fluid that is a refined fuel.

30. a process as claimed in claim 17, wherein the hydrogen sulphide scavenging agent is used to reduce the level of hydrogen sulphide in a fluid comprising sewage gas.

* * * * *